US009303956B1

(12) United States Patent
Booher, Sr.

(10) Patent No.: US 9,303,956 B1
(45) **Date of Patent: *Apr. 5, 2016**

(54) NON-METALLIC ARMOR ARTICLE AND METHOD OF MANUFACTURE

(71) Applicant: TechDyne LLC, Scottsdale, AZ (US)

(72) Inventor: Benjamin V. Booher, Sr., Scottsdale, AZ (US)

(73) Assignee: TechDyne LLC, Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/154,696

(22) Filed: Jan. 14, 2014

Related U.S. Application Data

(60) Continuation of application No. 13/693,941, filed on Dec. 4, 2012, now Pat. No. 8,627,756, which is a continuation of application No. 12/511,860, filed on Jul. 29, 2009, now Pat. No. 8,322,268, which is a continuation-in-part of application No. 11/774,818, filed on Jul. 9, 2007, now Pat. No. 7,866,249, which is a division of application No. 11/051,309, filed on Feb. 4, 2005, now Pat. No. 7,331,270.

(60) Provisional application No. 61/084,369, filed on Jul. 29, 2008, provisional application No. 61/092,176, filed on Aug. 27, 2008.

(51) Int. Cl.
*F41H 5/04* (2006.01)

(52) U.S. Cl.
CPC ..... *F41H 5/04* (2013.01); *F41H 5/0485* (2013.01)

(58) Field of Classification Search
CPC ..... F41H 5/0485; B29C 47/00023; B29C 47/065; B29C 47/02; B29C 47/0023
USPC ..... 89/36.02; 190/49.5, 58, 76, 80; 428/911
See application file for complete search history.

(56) References Cited

U.S. PATENT DOCUMENTS

| | | | | |
|---|---|---|---|---|
| 3,837,985 | A | 9/1974 | Chase | |
| 5,070,764 | A | 12/1991 | Schevach et al. | |
| 5,102,723 | A | 4/1992 | Pepin | |
| 5,156,787 | A | 10/1992 | Booher | |
| 5,354,066 | A | 10/1994 | Swanson et al. | |
| 5,462,620 | A | 10/1995 | Booher | |
| 5,495,922 | A | 3/1996 | Booher | |
| 5,591,933 | A | 1/1997 | Li et al. | |
| 5,690,770 | A | 11/1997 | Booher | |
| RE36,705 | E | 5/2000 | Booher | |
| 6,479,413 | B1 | 11/2002 | Booher | |
| 6,526,861 | B1 | 3/2003 | Gruber | |
| 8,627,756 | B1 * | 1/2014 | Booher, Sr. | 89/36.02 |
| 8,753,733 | B2 * | 6/2014 | Pilpel | 428/105 |
| 2002/0037391 | A1 * | 3/2002 | Harpell et al. | 428/103 |
| 2007/0194490 | A1 * | 8/2007 | Bhatnagar et al. | 264/258 |

* cited by examiner

*Primary Examiner* — Bret Hayes
(74) *Attorney, Agent, or Firm* — Booth Udall Fuller, PLC

(57) ABSTRACT

A non-metallic armor article comprises a pultruded housing defining at least one cavity. A plurality of substantially dry ballistic impact resistant broad goods sheets are at least partially enclosed in the cavity and held in suspension independently within the cavity. The pultruded housing is engaged with the plurality of substantially dry ballistic impact resistant broad goods sheets by being secured to one or more of the plurality of substantially dry ballistic impact resistant broad goods sheets.

23 Claims, 7 Drawing Sheets

NON-METALLIC ARMOR ARTICLE AND METHOD OF MANUFACTURE

CROSS REFERENCE TO RELATED APPLICATIONS

This Application is a continuation of the earlier U.S. patent application Ser. No. 13/693,941 entitled "Non-Metallic Armor Article and Method of Manufacture," filed on Dec. 4, 2012, now issued as U.S. Pat. No. 8,627,756, which application is a continuation of the earlier U.S. patent application Ser. No. 12/511,860 entitled "Non-Metallic Armor Article and Method of Manufacture," filed on Jul. 29, 2009, and issued as U.S. Pat. No. 8,322,268 on Dec. 4, 2012, which application claims priority to United States Provisional Patent Application entitled "Non-metallic armor article and Method of Manufacture," Ser. No. 61/084,369, filed Jul. 29, 2008, and to the United States Provisional Patent Application entitled "Non-metallic armor article and Method of Manufacture," Ser. No. 61/092,176, filed Aug. 27, 2008, and is a continuation-in-part of the earlier United States Patent Application entitled "Pultruded Non-Metallic Damage-Tolerant Hard Non-metallic armor article and Method of Manufacture Thereof," Ser. No. 11/774,818, filed on Jul. 9, 2007, now issued as U.S. Pat. No. 7,866,249, which application is a Divisional of the earlier United States Patent Application entitled "Pultruded Non-Metallic Damage-Tolerant Hard Non-metallic armor article and Method of Manufacture Thereof," Ser. No. 11/051,309, filed on Feb. 4, 2005, now issued as U.S. Pat. No. 7,331,270, the disclosures of which are hereby incorporated herein by reference.

BACKGROUND

1. Technical Field

This document relates to the field of armor to protect vehicles and other objects against damage from ballistic devices such as small arms ammunition, fragmentation from explosive devices, and the like. More particularly, this document relates to "non-metallic" armor, that is, armor that is not composed primarily of metal.

2. Background Art

Armed confrontations may occur with alarming frequency in today's world. Such confrontations may range from organized warfare to urban police encounters, and may include such activities as guerrilla warfare, exchanges between security forces and irregulars, encounters with gangs or individual criminals, and/or terrorist attacks. Targets of such attacks and encounters may be military personnel, police, and other security forces, or civilians, either as individuals or in small or large groups.

When people who anticipate that they might be the targets of such attacks are in open areas, many commonly wear body armor to prevent injuries from bullets or fragmented metal from explosive devices. Police officers, military personnel and security officers commonly wear such body armor. However, when such people are riding in vehicles, due to issues of practicality and comfort, many do not wear the body armor. Further, civilians who are riding in vehicles do not normally have body armor even if it would be valuable to wear it, since most do not anticipate that they will be attack targets. For those riding in a vehicle, the best protection is to armor the vehicle. Armoring of vehicles has been done for a long time. Normally such armoring has involved attachment of heavy metal plates (usually steel plates) to the exterior of the vehicles or, where vehicle appearance remains important, placed within the body walls and doors of the vehicle. Such metal plates are usually extremely heavy, very difficult to install, adversely affect the performance of the vehicle, and are costly. All of these adverse factors affect not only the use of armoring for civilian vehicles such as cars and trucks but also armoring of military vehicles, since the military has limited funds and personnel available for extensive armor-related projects.

It is desirable to have available vehicle armor which is lightweight, effective, readily installed and replaced if damaged, and which is available at reasonable cost, to insure that the maximum number of vehicles can be armored and the armor can be readily maintained by immediately available personnel without major diversion of such personnel from other necessary duties. It is further desirable for such armor to also be useful for protection of structures other than vehicles, such as buildings of many types, including hard-wall and soft-wall buildings. In addition, it is desirable to have a method for the manufacture of such armor based on a refined, well-developed, technically advanced process, which provides high production rates and high quality product, and which is also cost-effective.

SUMMARY

Aspects of this document relate to non-metallic armor articles. In one aspect, this disclosure relates to a method of manufacturing bulk ballistic laminate articles comprising aligning a plurality of ballistic broad goods sheets in a planar array and feeding a resin compound into the planar array to create at least one cross-sectional wet-out path of resin compound in a selected geometry, wherein portions of the plurality of ballistic broad goods sheets in the planar array around the at least one cross-sectional wet-out path are substantially dry.

Particular implementations may include one or more of the following: The method may further comprise pultruding a housing around the planar array of ballistic broad goods sheets and the at least one cross-sectional wet-out path of resin compound, the housing and cross-sectional wet-out path defining a continuous cavity within the housing, and the cavity encompassing at least a portion of the substantially dry planar array. In more particular implementations, the cross-sectional wet-out path may be continuous, and the method may further comprise cutting the portion of the substantially dry planar array from a remainder of the planar array by cutting along the continuous cross-sectional wet-out path of resin compound. The selected geometry may have a curvilinear shape, and the plurality of ballistic broad goods sheets in the planar array within the curvilinear shape forms a curvilinear array of ballistic broad goods sheets.

Particular implementations may further comprise forming a housing around the planar array of ballistic broad goods sheets by at least one of resin infusion, pressure molding, compression molding, press forming, vacuum forming, and injection molding. The resin compound may be fed into the planar array in-line with a pultrusion process that adds a housing around the planar array. The resin compound may be fed into the planar array directly to each sheet of the plurality of ballistic broad goods sheets in the planar array. The resin compound may be fed into the planar array to at least one of the sheets of the plurality of ballistic broad goods sheets in the planar array by feeding the resin compound through another of the sheets in the planar array.

The selected geometry may comprise a plurality of resin pads positioned at various locations throughout the plurality of ballistic broad goods sheets in the planar array so that each layer of the planar array comprises at least one resin pad joining it to an adjacent layer of the planar array. The selected geometry may further comprise at least two resin pads on adjacent layers of the planar array being aligned with each other. The resin pads may be formed by feeding the resin compound through adjacent sheets to a majority of the sheets in the planar array.

In particular implementations, the resin compound-fed planar array comprises a ballistic laminate, and the method may further comprise: forming a housing inner portion around a mandrel, placing at least one ballistic laminate around the housing inner portion, and forming a housing outer portion over the housing inner portion and the at least one ballistic laminate to form a ballistic laminate article.

In particular implementations, forming the housing inner portion may comprise forming the housing inner portion around the mandrel with a wet forming process. Forming the housing outer portion may also comprise forming the housing outer portion around the mandrel with a wet forming process. Forming the housing outer portion may also comprise forming the housing outer portion around the mandrel by at least one of resin infusion, pressure molding, compression molding, press forming, vacuum forming, and injection molding.

In particular implementations, feeding the resin compound into the planar array may comprise injecting the resin compound into the planar array through a plurality of resin injection needles near simultaneous with forming a housing around the planar array through pultrusion of the planar array and the housing through a fabrication mechanism. Aligning a plurality of ballistic broad goods sheets in a planar array may comprise aligning the plurality of ballistic broad goods sheets in the planar array with predetermined spacings between the sheets.

According to another aspect, a method of forming a non-metallic armor article may comprise: aligning a plurality of ballistic impact resistant broad goods sheets in a planar array of ballistic impact resistant broad goods, and pultruding a housing around the planar array of ballistic impact resistant broad goods sheets, the housing defining a cavity within the housing, the cavity encompassing at least a portion of the planar array such that the encompassed portions of the ballistic impact resistant broad goods sheets within the cavity are substantially dry.

Particular implementations may include one or more of the following: The method may further comprise suffusing only a portion of the at least two ballistic impact resistant broad goods sheets in the planar array with a resin compound prior to pultruding the housing around the planar array such that the spatial relationship between the at least two ballistic impact resistant broad goods sheets is maintained and the encompassed portions remain substantially dry. Suffusing only a portion of the at least two ballistic impact resistant broad goods sheets in the planar array may comprise suffusing a continuous resin saturated area surrounding a portion of the planar array within the cavity of the housing and spaced from a boundary of the housing, the portion of the planar array surrounded by the continuous resin saturated area comprising substantially dry ballistic impact resistant broad goods sheets. Suffusing only a portion of the at least two ballistic impact resistant broad goods sheets in the planar array may comprise suffusing a plurality of resin saturated areas at predefined locations within a planar boundary of the housing. Suffusing only a portion of the at least two ballistic impact resistant broad goods sheets in the planar array may comprise forming a continuous resin compound portion extending between a top housing layer and a bottom housing layer.

In particular implementations, the method may further comprise cutting through the housing on the continuous resin saturated area surrounding the portion of the planar array and removing the portion of the planar array surrounded by the continuous resin saturated area, a portion of the housing and a portion of the continuous resin saturated area, at least one of the removed and remaining portions comprising the non-metallic armor article. Particular implementations may further comprise simultaneously suffusing only a portion of the at least two ballistic impact resistant broad goods sheets in the planar array with a resin compound while pultruding the housing around the planar array such that the spatial relationship between the at least two ballistic impact resistant broad goods sheets is maintained and the encompassed portions remain substantially dry. Pultruding the housing may comprise spacing the pultruded housing from the planar array of ballistic impact resistant broad goods sheets.

In another aspect, a non-metallic armor laminate article may comprise: a pultruded laminate housing defining at least one cavity, and a plurality of substantially dry ballistic impact resistant broad goods sheets in a planar array within the cavity and held in spatial relationship by side-walls to the cavity.

Particular implementations may comprise one or more of the following: The at least one cavity of the armor article may comprise two or more cavities, each cavity comprising a portion of the plurality of substantially dry ballistic impact resistant broad goods sheets. The two or more cavities may be separated from one another by a substantially parallel and/or substantially horizontal cavity division, or at some other angle. The spatial relationship separating the at least two substantially dry ballistic layers may measure from about 1 nm (10-9 m) to about 25,000 nm or greater.

Particular implementations of an armor article may further comprise a supplemental layer interposed between the pultruded housing and at least one of the plurality of substantially dry ballistic impact resistant broad goods sheets. Particular implementations may further comprise a resin saturated area located between one or more boundaries of the pultruded housing. The resin saturated area may be delineated by one or more template patterns located on an outer surface of the pultruded housing. The resin saturated area may comprise a continuous resin saturated area extending through the planar array between a top housing layer and a bottom housing layer, the continuous resin saturated area forming the side-walls of the cavity.

The foregoing and other aspects, features, and advantages will be apparent to those having ordinary skill in the art from the DESCRIPTION and DRAWINGS, and from the CLAIMS.

DETAILED DESCRIPTION

Figure 1:
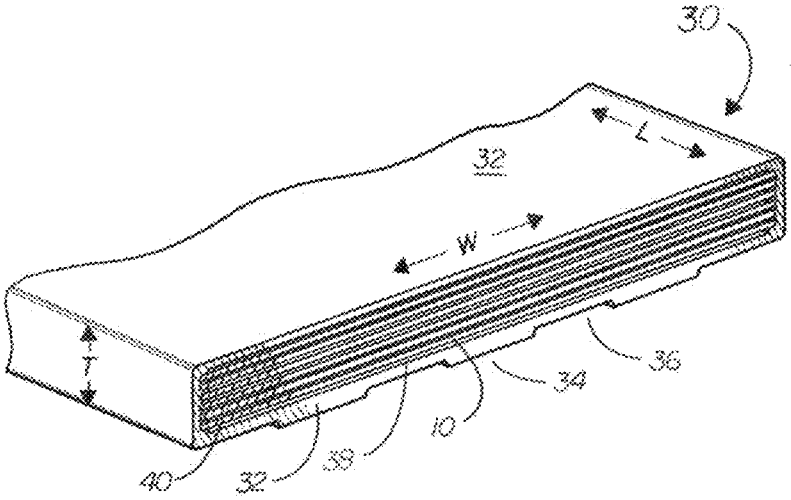
FIG. 1 is an end or cross-sectional view of a first particular implementation of non-metallic armor article.

The present document relates generally to "non-metallic" armor. As defined herein, a "non metallic" armor is an armor that is not primarily composed of metal. Traditional metal armor, such as armor plating, is formed from masses of metal, commonly iron or steel. While such metallic armor is commonplace today, and in fact many "armored" vehicles are either directly made of such metallic armor (e.g., the bodies of tanks) or are otherwise covered with sheets of such metallic armor, such is not relevant to the present document. The present armor is a non-metallic armor that is formed with little or no metal. It finds primary use for application to "unarmored" vehicles, such as automobiles, utility vehicles and many kinds of trucks, of both light and heavy duty varieties, to provide for ballistic impact protection to such vehicles which (although of course being made in large part of metal) are not themselves capable of effectively withstanding such ballistic threats while protecting their contents and occupants.

Various particular implementations of non-metallic armor, along with their methods of manufacture using pultrusion (and other related methods) are described herein. The scope of the present disclosure therefore may be, in some particular implementations, based on an intersection of the product and its method of manufacture. While the product and process of manufacture both incorporate some elements from the prior art, the claimed products and processes of manufacture represent combinations and enhanced performance which are significantly different from the structures and methods in which such prior art elements were found in the past.

The various implementations of non-metallic armor articles disclosed are designed to provide an improved and cost effective hard armor for use on vehicles, structures and other similar applications. The fabrication processes disclosed provide for securing and retaining engineered protective broad goods in exact orientation as a substantially dry laminate during manufacturing and within the finished armor product. In particular implementations, as the broad goods are pulled into position or after they are pulled into position, an outer hard-shell (pultruded housing, described below) is formed around the dry laminate. This hard shell forms a pultruded housing which secures the broad goods not only in exact orientation but also in prescribed tension. Since the broad goods thus remain substantially dry within the final pultruded product, they are able to provide increased ballistic performance over non-dry broad goods. Furthermore, because of the hard encasement to the dry broad goods, the broad goods layers are not subject to repeated bending or distortion that can cause abrading as occurs with conventional soft armor. Conversely, unlike existing hard armor, the cross section of the various particular implementations of non-metallic armor articles disclosed herein do not include a resin matrix that can compromise the individual ability of the fibers to the broad goods from performing their work in discharging kinetic energy from the ballistic threat; thereby providing increased protection and damage tolerance.

As described further below, the various implementations of non-metallic armor articles disclosed may be formed by pultruding (i.e., drawing or pulling) one or a plurality of sheets or layers of engineered dry ballistic resistant broad goods into a cavity of a fiber reinforced polymeric composite material body during its simultaneous formation by pultrusion and curing as a pultruded housing for the broad goods layers. This outer pultruded housing, which at least partially encloses a portion of the dry broad goods, may comprise a resin-impregnated roving and may also include additional broad goods that, together, are formed and cured by the pultrusion process to wrap the dry ballistic engineered broad goods in a protective and structural covering. Upon curing of the pultruded housing material (curing may involve the application of heat, in some particular implementations), the broad goods layers become at least partially engaged with and secured within the pultruded housing, as will be described in more detail below.

Engineered ballistic-resistant broad goods are well known, and many different types of commercially available materials may be used in the various implementations of non-metallic armor articled described and made possible from an understanding of the principles taught herein. The concept of using ballistic-resistant broad goods for protection against ballistic impact is well known. Broad goods (such as one or more of the plurality substantially dry broad goods sheets described further herein) are typically made as dry mats or weaves consisting of a multitude of fibers which, upon being struck by a projectile such as a bullet, deform, compact, and/or elongate in order to absorb and dissipate the kinetic energy of the projectile.

The layering of multiple broad goods substantially increases the effectiveness of armor, as each successive layer further reduces the kinetic energy of a projectile. When the layers are in a multiple array, the tension of each layer and the spacing between them may be arranged such as to allow each layer to deform and elongate appropriately to provide the optimum absorption of energy at each layer. Those skilled in the art can readily determine proper tension and spacing based on the ballistic impacts that the particular non-metallic armor article is anticipated to encounter. It is contemplated that the various layers in an array may be tensioned at substantially the same tension levels, at different tension levels, or slacked depending upon the particular needs of an implementation based on its intended use and the broad goods used. It is also contemplated that development of such broad goods will continue and that new such broad goods not currently known or used will come into the marketplace. It is anticipated that such newly developed broad goods may be equally applicable in the particular implementations of non-metallic armor articles disclosed herein. Suitable ballistic-resistant broad goods are commonly made of fibers that include, but are not limited to glass fibers, aramid fibers (e.g., Kevlar®), or similar fibers, and/or any combination thereof. The architecture of the basic broad goods may also vary from application to application. Specifications including the general fiber filament size, count, and type as well as the general fiber orientation to the woven, mat, or other "fabric" may vary, particularly as required for adaptation to specific ballistic threats.

Figure 4:
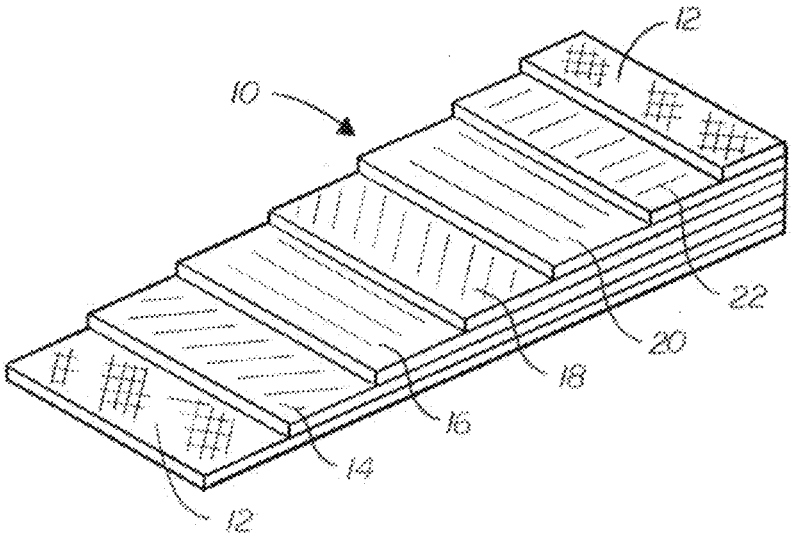
FIG. 4 is a schematic view of a typical array of ballistic impact-resistant broad goods sheets of the type useful in non-metallic armor article implementations.

A typical example of a ballistic fiber broad good is shown in FIG. 4, in which broad goods laminate 10 is formed of a series of fiber fabric sheets or layers 14, 16, 18, 20, 22 covered on both outer surfaces by protective fiber mats 12. The fibers in the layers may have different orientations, to spread the effects of ballistic impacts. In the embodiment shown in FIG. 4, the fibers in layer 14 are oriented at −(20E-90E) (0E designating the longitudinal axis of the material with plus-angles being to the left in the Figure and minus-angles to the right, as indicated by the lining shown in each layer), layer 16, 90E; layer 18, +(20E-90E); layer 20, 90E; and layer 22, 0E. One particular fiber product of interest, due to its ready supply, satisfactory properties, and cost effectiveness is PPG Industries' Hybon™ 2022 Roving. While numerous varieties of this product exist, one that is particularly suitable is the 190 yield, 275 TEX, K filament (13 micron) silane-sized continuous strand roving.

Figure 2:
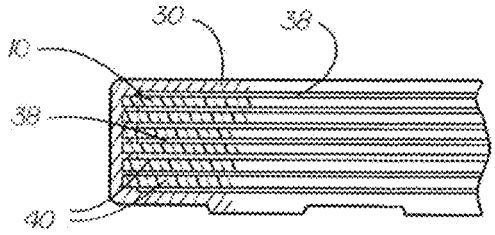
FIG. 2 is a detailed view of one side of the non-metallic armor article of FIG. 1, illustrating the interconnection of the armor layers and the enclosing pultruded housing.

The general configuration of the pultruded housing 32 (with the encased substantially dry broad goods sheets) to form the armor product 30 is illustrated in FIGS. 1 and 2. The pultruded housing 32 is formed around the edges 40 of multiple layers of broad goods 10 which are exactly oriented relative to each other and the main shell of the pultruded housing by a series of representative spacings 38. The resin of the pultruded housing flows around the edges 40 of the sheets 10 as best seen in FIG. 2 and secures them in place with the desired tension and spatial relationship within the limits of representational spacings 38. The laminate armor 30 thus consists of the pultruded housing and secured therein, the ballistic-resistance layers 10. Since the pultruded housing 32 is rigid, the armor is hard and the broad goods 10 are held in prescribed position. Nevertheless, since the broad goods are in contact with the pultruded housing resin at their peripheries, and are "dry," meaning that while the fibers used to produce the broad goods may be treated with some amount of chemical coating, such as sizing, during their original point of manufacture, and/or further treated but not fully bound by resin approximate the time they are woven into broad goods, they are not further wet out or bound within the resin matrix of armor articles produced by the process of this invention. In this way, they are "substantially dry" broad goods sheets that are not restricted beyond their manufactured state within the of armor articles. If desired, the pultruded housing 32 surface can be formed during the pultrusion with lands 34 and valleys 36 running along the side of the armor product 30 which is to be attached to the vehicle. This aids in providing structure to the armor product, as well as handling and storage of the products, mounting of each product to a vehicle, and retention of the product on the vehicle, the last since it allows for some expansion, contraction, moisture drainage, etc. of the vehicle body in different weather conditions.

The specifications of the outer impregnated and cured pultruded housing 32 that locks the highly engineered broad goods in alignment within the finished products is also application specific. The proper wall dimension of the pultruded housing 32 provides structure to the specific application while also not impeding the ballistic component of the dry and precisely contained ballistic fibers. Therefore, it may be desirable in many applications for the wall thickness of the outer shell to vary. This further feature can provide a highly rigid structure to the inner face while presenting a less rigid, but fully environmentally resistant outer skin that will not adversely affect the physics involved in providing efficiency to the disposition and management of kinetic energy imposed during a ballistic threat. Those skilled in the art can readily determine the appropriate makeup and thicknesses of pultruded housing wall for various vehicles and for ease of handling and intended performance. Typically, the thickness (dimension "T" in FIG. 1) will be on the order of 0.50 to 1.50 inches (1.27 to 3.81 cm). The width ("W") dimension will be determined by the capabilities and dimensions of the pultrusion equipment, while the length ("L") dimension is a matter of choice, since it represents where each armor product unit 30 is cut from the pultrusion as it exits from the manufacturing operation. Width capabilities of pultrusion equipment are currently common up to or beyond 50 inches (125 cm). The length dimensions will be determined primarily by the sizes most commonly needed and the ability of personnel to handle them easily. It is recognized that larger vehicle areas may need to be protected by more than a single armor pultrusion product can cover, so individual products 30 can be appropriately abutted and/or overlapped on a vehicle as generally illustrated at 50 in FIG. 3.

The materials from which the pultruded housing 32 is made can be any of a variety of polymeric matrix materials (housing substrate), normally thermosetting materials, reinforced with any one or more of a variety of different fibrous materials. Suitable thermosetting matrix polymers include, but are not limited to, cross-linked polyethylene or polypropylene, phenolics, epoxides, polyesters, silicones, and vinylesters. Reinforcing fiber yarns and strands may be of glass, ceramic, graphite, various synthetics, silica and the like.

Figure 3:
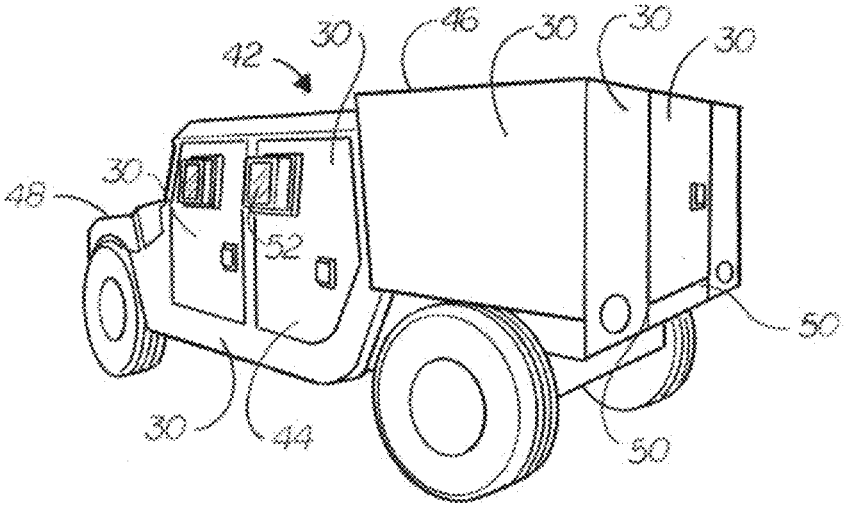
FIG. 3 is a perspective view of a typical vehicle to which the non-metallic armor article of FIG. 1 has been attached.

An example of an application of for armor products 30 is illustrated in FIG. 3, which shows a typical military or utility vehicle 42 of conventional configuration having a cab 44 for the driver and passengers, a cargo compartment 46 and an engine compartment 48. Armor products 30 may be attached to any or all of these, as shown. Attachment is in generally the same manner as used for metallic armor, of course recognizing that attachment will be much simplified over that of metallic armor because of the much lighter weight of the various particular implementations of non-metallic armor articles disclosed herein.

While armor products 30 may be in the configuration of simple flat sheets, the products can likewise be pultruded in various configurations including flat and curved panels of specifically engineered dimensions (As described further below with respect to FIG. 10). It will be evident from the example provided in FIG. 3 that many different shapes and sizes of the products 30 are contemplated. Ordinarily, doors, hoods, trunks and similar openable or liftable structures will be covered independently of the covering of the body of the vehicle to facilitate operation of those structures. Small specialized product units can also be fabricated and used, as exemplified by the small box protective enclosure 52 shown surrounding a window on the side door of the vehicle in FIG. 3.

As noted, pultrusion processes in general are well known and thoroughly developed. They are best described in my prior U.S. Pat. No. 5,156,787 (1992); U.S. Pat. No. 5,462,620 (1995) and U.S. Pat. No. 5,495,922 (1996), with more recent aspects also described in my prior U.S. Pat. No. 5,690,770 (1997) and U.S. Pat. No. 6,479,413 (2002). Commercial pultrusion manufacturing plants are in current operation in the United States based on the principles described in these patents. With respect to a first process implementation of the present disclosure, the first pultrusion process differs from the prior art pultrusion processes (which are commonly used for production of solid-section products) in that a forming die 60 (FIG. 5) is structured to form a pultruded housing 32 instead of a solid friction material block, and simultaneously to lay in the broad goods 10 into the dry cavity of the pultruded housing 32, such that the pultruded armor product 30 has a structure similar to that shown in FIGS. 1 and 2. This is illustrated schematically in FIG. 5, in which the broad goods 10 are shown disposed to be fed over rollers 58 disposed between the rollers 56 for feeding in the fiber impregnated reinforced polymeric pultrusion stock 54. The sheets 10 and stock 54 are shown as widely spaced for clarity in the diagram. They may of course actually have the appearance and close spacing otherwise described herein, such spacing which may be transient along any span of broad goods as compacting and natural deformation of the broad goods within the article is beyond the control of the housing portions further described herein.

Crosshatching is shown for the purpose of differentiating the different components and not for the purpose of defining materials. In the particular implementation shown with respect to FIG. 5, there are four layers of broad goods 10; as discussed above, any convenient number can be selected depending on the type of armor of interest. The assemblage passes through the forming die 60 in the direction of the arrow and in the manner well known for pultrusion and shown in my previous patents, and when the assemblage exits from the forming die 60 the outside shell or pultruded housing 32 has been formed by curing of the polymeric stock 54 with the broad goods 10 secured therein with the proper locations and spacing steps 38. The armor products 30 may then be cut off seriatim at desired lengths as well known and illustrated in my prior patents.

Figure 5:
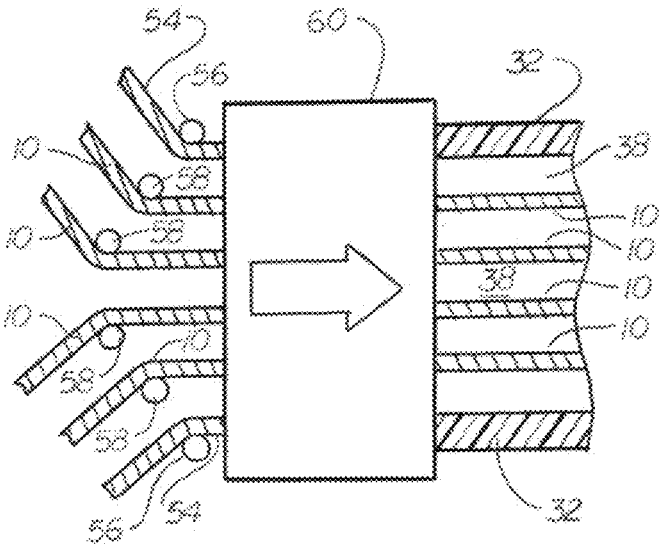
FIG. 5 is a schematic diagram of formation of the non-metallic armor article by use of the pultrusion process disclosed herein.

The pultrusion process disclosed with reference to FIG. 5 is capable of producing non-metallic armor article products at the rate of up to 50 in/min (125 cm/min) or greater for panels of up to 50 in (125 cm) in width and wider. The process is well proven, and the current commercial control mechanisms in use allow for the desired reproducibility. Some of the non-metallic armor article products disclosed may characteristically have a weight of about 5 lb/ft$^2$ (24 kg/m$^2$). These may have an effectiveness generally equal to that of ⅜ in (1 mm) thick RHA steel plates weighing 15 lb/ft$^2$ (72 kg/m$^2$). It will be evident that the armor products 30 may be as much as three times more effective than steel plate on a weight basis, thus allowing substantial weight reduction on armored vehicles. Such weight reduction has substantial operational benefits, such as better fuel efficiency for the vehicle, ability for the vehicle to traverse roads, bridges or other structures that have low load-carrying capabilities, and, if desired, the ability for the vehicle itself to carry replacement panels for field repairs while still weighing less in total than a similar vehicle with metal armoring.

Yet another benefit of the non-metallic armor article products disclosed herein is their favorable thermal properties. Polymeric materials are well known to absorb less heat, maintain lower surface temperature and have substantially less thermal expansion and contraction than metal plates. Thus, for a vehicle in use in a desert or other hot climate, the interior temperature of a vehicle in the sun may be significantly less than it would if the vehicle had been armored with metal plates, thus affording more comfort for the vehicle's occupants and less likelihood of heat damage to vehicle contents, while also potentially reducing the vehicle heat signature that can be used for targeting by the unfriendly force.

Turning now to FIGS. 6-9, these figures illustrate a variety of particular implementations of non-metallic armor articles, all of which include a pultruded housing 32. In any of the particular implementations of non-metallic armor articles disclosed with respect to FIGS. 6-9, a pultruded housing 32 comprises an inner surface 66, an outer surface 68, and at least one peripheral edge 70. In addition, a pultruded housing 32 defines at least one cavity 72. As described further below, a non-metallic armor article may comprise several cavities 72. A cavity 72 may serve to allow the plurality of substantially dry ballistic impact resistant broad goods 10 to be suspended in a dry area in a state of tension, compression, or substantially zero additional stress (slack). In some particular implementations, a cavity 72 may be filled with particles (such as nano-particles, by way of non-limiting example) that may serve as a filler material, as a support material, as a shock absorbent material, as a fire retardant material, and/or to improve the performance of the non-metallic armor article by dispensing more of a potential threat's energy to be absorbed by the nano materials. The use of nano materials or other filler material provides the support and other possible functions described, but still allows the fibers of the broad goods 10 to not be rigidly locked in place by hardened resin.

In any event, the at least one cavity 72 comprises at least one upper wall 74 and at least one lower wall 76. It will be appreciated that virtually any material or combination of materials can be used to form a pultruded housing 32. By way of non-limiting example, and as described further below with respect to FIG. 10, a pultruded housing 32 may comprise a polymer, a ceramic, a metal, a fabric, a composite, or any other material or combination of materials.

With respect to any of the particular implementations of non-metallic armor articles disclosed with respect to FIGS. 6-9 (or any other particular implementations of non-metallic armor articles made possible from the disclosures contained herein), a pultruded housing 32 at least partially encloses a plurality of substantially dry broad goods sheets 10 (which may be at least partially enclosed by a cavity 72 of a pultruded housing 32). Moreover, in any of the particular implementations of non-metallic armor articles disclosed herein, a pultruded housing 32 engages the plurality of substantially dry broad goods sheets 10 via the at least partial securement of the pultruded housing 32 to one or more of the plurality of substantially dry broad goods sheets 10. Also, with respect to any of the particular implementations of non-metallic armor articles disclosed herein, the plurality of substantially dry broad goods sheets 10 may each comprise a top surface 78, a bottom surface 80, and one or more side edges 82.

The type of material and/or dimensions of one or more of the plurality of substantially dry broad goods sheets 10 used in any particular implementation may vary according to the particular implementation of non-metallic armor article being formed. For example, one or more substantially dry broad goods sheets 10 may be identical to one another, or one or more of the plurality of substantially dry broad goods sheets 10 may be different from one another. In addition to the possibility that two or more of the plurality substantially dry broad goods sheets 10 may comprise different materials and/or dimensions than one another, the number of the plurality substantially dry broad goods sheets 10 used in a particular implementation of a non-metallic armor article may vary according to the particular implementation being used. By way of non-limiting example, a comparison of FIG. 6 to FIG. 9 illustrates that while the second particular implementation of non-metallic armor article 62 illustrated in FIG. 6 comprises three (3) substantially dry broad goods sheets 10*a*-10*c*, while the third particular implementation of non-metallic armor article 86 illustrated in FIG. 7 comprises just two (2) broad goods sheets 10*a*-10*b*.

By way of further non-limiting example, in those particular implementations having more than one layer of substantially dry broad goods sheets 10, the layers of substantially dry broad goods sheets 10 may all comprise the same type of ballistic fabric, or various different types of ballistic fabric may be used. The ballistic fabric may utilize any type of fiber. For instance, the ballistic fiber may comprise fibers of aramid (such as Kevlar), carbon, boron, glass, or any other type of natural, synthetic or hybrid fiber.

In addition, as described more fully below with respect to FIG. 6, the plurality of substantially dry broad goods sheets 10 may comprise a ballistic broadgood or a 3-D ballistic panel (and/or any combination thereof) configured to be resistant to a ballistic projectile such as a bullet, an ordnance, shrapnel, other fragments or particles emanating from a blast or explosion, and/or any other item that could injure a person or damage a vehicle, structure, or other property. It will be understood by those of ordinary skill in the art that in those particular implementations where the plurality of substantially dry broad goods sheets 10 comprise ballistic 3-D panels, such ballistic 3-D panels may include one or more bundled and/or knitted and/or stitched and/or otherwise structured arrays (or the like) comprising one or more fibers and/or materials or any suitable ballistic-resistant composition and/or geometry.

The one or more substantially dry broad goods sheets 10 may utilize any fabric architecture and, in some particular implementations of non-metallic armor articles, the fabric architecture may vary from layer to layer as may be desirable for a particular application of the technology. For instance, one or more of the plurality substantially dry broad goods sheets 10 may be oriented differently from another or offset a certain number of degrees. If the fibers in the one or more of the plurality of substantially dry broad goods sheets 10 are oriented uni-directionally, as an example, the one or more of the plurality of substantially dry broad goods sheets 10 may be oriented so that the fibers are offset from layer to layer a certain amount of degrees, or the direction of fibers from layer to layer may be random, or the direction of fibers from layer to layer may be substantially the same direction, or any combination of the foregoing. As described further with respect to FIG. 11 below, one or more fibers within any individual substantially dry ballistic layer 10 may be oriented in any manner, such as uni-directionally, randomly, or multi-directionally. Significantly, there is virtually no limit to the number of substantially dry broad goods sheets that may be used. In the case of ballistic panels specifically, any process may be used to fix the panels' architecture including without limitation, stitching and/or weaving and/or twisting and/or pre-preg bonding.

Figure 6:
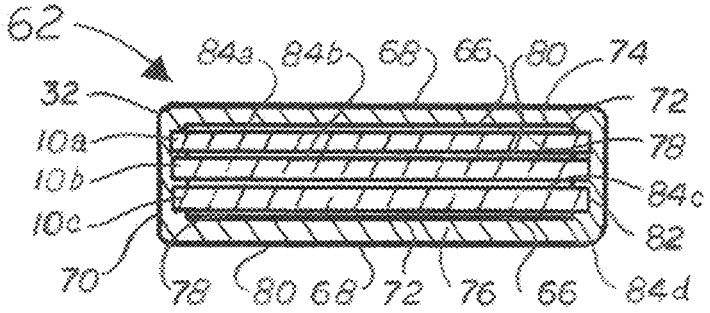
FIG. 6 is a front cut-away view of a second particular implementation of a non-metallic armor article.

Turning now to the non-limiting example provided in FIG. 6, this figure illustrates a cross sectional view of a second particular implementation of a non-metallic armor article 62. As illustrated, a pultruded housing 32 at least partially encloses the plurality of substantially dry broad goods sheets 10 (three substantially dry broad goods sheets 10 in this particular implementation). The plurality of substantially dry broad goods sheets 10 are at least partially enclosed by a cavity 72 which, as described above, is defined by the pultruded housing 32. Depending upon the particular implementation being embodied, a pultruded housing 32 may fully enclose one or more of the plurality of substantially dry broad goods sheets 10. Notwithstanding, in other particular implementations, the pultruded housing may only partially enclose one or more of the plurality of substantially dry broad goods sheets 10.

In any event, the pultruded housing 32 engages at least one of the plurality of substantially dry broad goods sheets 10. In some particular implementations, a peripheral edge 70 of the pultruded housing 32 may engage one or more of the plurality of substantially dry broad goods sheets 10 only adjacent to their side edges 82. Nevertheless, in other particular implementations, a portion of the pultruded housing 32 other than a peripheral edge may engage one or more of the plurality of substantially dry broad goods sheets 10 at a location other than one or more of their side edges.

With respect to any of the particular implementations illustrated in FIGS. 6-9, one or more of the substantially dry ballistic impact resistant broad goods sheet 10 may be separated from one another and/or the pultruded housing 32 by spacing 84. In some particular implementations, spacing 84 between individual layers of the plurality of substantially dry broad goods sheets 10 may position the individual broad good sheets in direct contact with one another such that the two (or more) broad goods sheets 10 are in physical communication with one another and/or are substantially coextensive with one another. It will be understood that the number, arrangement, and dimensions of one or more spacings 84 may vary according to the particular implementation of non-metallic armor article being used. For example, referring to FIG. 6, non-metallic armor article 62 comprises four spacings 84: 84*a*, 84*b*, 84*c*, and 84*d*. In this particular implementation, spacing 84*a* separates an inner surface 66 (and/or the upper wall 74 of the cavity 72) of the pultruded housing 32 from the top surface 78 a first substantially dry ballistic layer 10*a*. In addition, spacing 84*b* separates the bottom surface 80 of the first substantially dry ballistic layer 10*a* from the top surface 78 of a second substantially dry ballistic layer 10*b*. Similarly, spacing 84*c* selectively separates the bottom surface 80 of the second substantially dry ballistic layer 10*a* from the top surface 78 of a third substantially dry ballistic layer 10*b*. In addition, spacing 84*d* selectively separates an inner surface 66 of the pultruded housing 32 (and/or the lower wall 76 of the cavity 72) from the bottom surface 80 of the third substantially dry ballistic layer 10*c*. With respect to the various particular implementations illustrated with respect to FIGS. 6-9, it will be understood that the dimensions of one or more spacings 84 (whether occurring between two or more substantially dry broad goods sheets 10, or between the plurality of substantially dry broad goods sheets 10 and a pultruded housing 32) may be substantially equal, or may differ from one another, depending upon the particular implementation being used.

Figure 7:
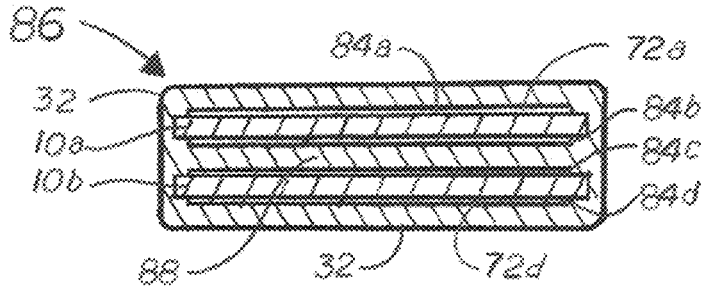
FIG. 7 is a front cut-away view of a third particular implementation of a non-metallic armor article.

Turning now to FIG. 7, this figure illustrates a third particular implementation of a non-metallic armor article 86 having two substantially dry broad goods sheets 10*a-b*. As illustrated, the pultruded housing 32 of non-metallic armor article 86 defines two cavities (a cavity 72*a* and a cavity 72*b*), that are separated by cavity division 88. Various cavity divisions 88 are possible, depending upon the particular implementation being used. For instance, a cavity division 88 may be oriented horizontally (horizontal cavity division 88, FIG. 7) or vertically (vertical cavity division 92, FIG. 8). Other particular implementations of non-metallic armor articles employing multiple cavity divisions 88 may utilize both a vertical cavity division 88 and a horizontal cavity division 92 (FIG. 8), or any combination of multiple cavity divisions of either variety. Significantly, depending upon the particular implementation being used, a cavity 72 may at least partially enclose one or more of the plurality substantially dry broad goods sheets 10 in each cavity 72 (as in non-metallic armor article 90 illustrated in FIG. 8), or there may be only one substantially dry broad goods sheet per cavity (as in non-metallic armor article 86 illustrated in FIG. 7). In those particular implementations where there are multiple substantially dry broad goods sheets 10 enclosed in each cavity 72, any number or varying numbers of substantially dry broad goods sheets 10 (and/or other fabrics and/or panels), could be disposed within each cavity 72.

Still referring to FIG. 7, a horizontal cavity division, such as cavity division 88, may be formed by pulling one or more suffused layers (similar to the pultruded housing 32 construction described above) between two or more substantially dry broad goods sheets 10. The suffused layer(s) may vary in construction, material, fiber, resin, and so forth, from the skin used for the pultruded housing 32. In any event, it will be understood that the first cavity 72*a* of non-metallic armor article 86 is defined by an upper wall 74 and cavity divider 88. At least partially enclosed by the cavity 72*a* is a plurality of substantially dry broad goods sheets 10 (a single substantially dry broad goods sheet 10*a* is enclosed by cavity 72*a* in this particular implementation). Significantly, in this particular implementation of non-metallic armor article 86, the top surface 78 of the ballistic layer 10*a* is separated from the upper wall 74 of the cavity 72*a* by spacing 84*a*. Likewise, the bottom surface 80 of ballistic layer 10*a* is separated from the cavity divider 88 (which forms both the lower wall of cavity 72*a* and upper wall of the cavity 72*b* in this particular implementation) by spacing 84*b*. Similarly, the top surface 78 of the ballistic layer 10*b* is separated from the cavity divider 88 by spacing 84*c*. Likewise, the bottom surface 80 of ballistic layer 10*b* is separated from the lower wall 76 of the cavity 72*b* by spacing 84*d*.

Figure 8:
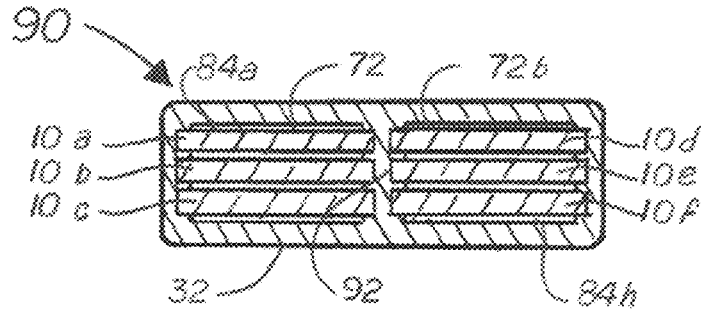
FIG. 8 is a front cut-away view of a fourth particular implementation of a non-metallic armor article.

Referring now to FIG. 8, a fourth particular implementation of a non-metallic armor article 90 is illustrated. Non-metallic armor article 90 includes vertical cavity division 92, which divides, or separates, cavity 72*a* from cavity 72*b*. Vertical cavity divisions may also be angular, to about +/−45° to 60° from the vertical axis and by such may provide energy absorbing mechanics to the armor products. Significantly, the cavity 72*a* and the cavity 72*b* each enclose three substantially dry broad goods sheets 10*a-c*. The top surface 78 of substantially dry ballistic layer 10*a* is selectively separated from the upper wall 74 of the cavity 72*a* by spacing 84*a*. In addition, the bottom surface 80 of substantially dry ballistic layer 10*a* is selectively separated from the top surface 78 of substantially dry ballistic layer 10*b* by spacing 84*b*. Moreover, the bottom surface 80 of substantially dry ballistic layer 10*b* is selectively separated from the top surface 78 of substantially dry ballistic layer 10*c* by a spacing 84*c*. Finally, the bottom surface 80 of substantially dry ballistic layer 10*c* is selectively separated from the lower wall 76 of the cavity 72*a* by spacing 84*d*. Cavity 72*b* of non-metallic armor article 90, as will be described further below, is arranged the same as cavity 72*a*.

Still referring to FIG. 8, the cavity 72*b* encloses three substantially dry broad goods sheets 10*d-f*. The top surface 78 of substantially dry ballistic layer 10*d* is selectively separated from the upper wall 74 of the cavity 72*b* by spacing 84*e*. In addition, the bottom surface 80 of substantially dry ballistic layer 10*d* is selectively separated from the top surface 78 of substantially dry ballistic layer 10*e* by spacing 84*f*. Moreover, the bottom surface 80 of substantially dry ballistic layer 10*e* is selectively separated from the top surface 78 of substantially dry ballistic layer 10*f* by spacing 84*g*. Finally, the bottom surface 80 of substantially dry ballistic layer 10*f* is selectively separated from the lower wall 76 of the cavity 72*b* by spacing 84*h*. It will be understood that while the cavity 72*a* and the cavity 72*b* of non-metallic armor article 90 are shown as being substantially the same, in some particular implementations the cavity 72*a* and the cavity 72*b* may be different and may enclose an unequal number of substantially dry broad goods sheets 10. Selective spacing may vary from zero to any desirable value.

Figure 9:
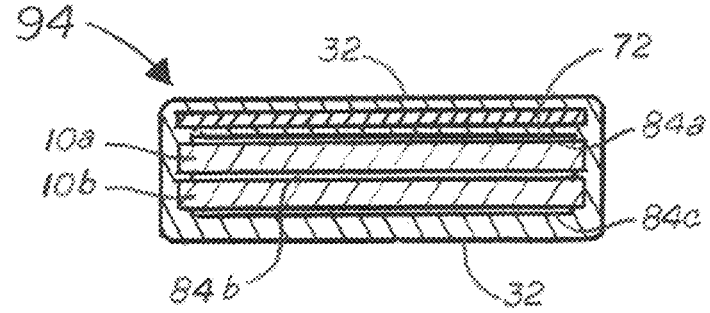
FIG. 9 is a front cut-away view of a fifth particular implementation of a non-metallic armor article.

Turning now to FIG. 9, this figure illustrates a fifth particular implementation of a non-metallic armor article 94. Non-metallic armor article 94 includes supplemental layer 96, which may include an additional layer or layers of specialized materials embedded in the pultruded housing 32. A supplemental layer 96 may comprise a specialized reinforcing material of any kind and can be added to the pultruded housing construction. In addition, a supplemental layer 96 may be made of any material, fiber, polymer sheets, wire mesh, or any other material demonstrating a desirable characteristic enhancing ballistic, fragment or blast resistance. A supplemental layer 96 may be embedded or at least partially enclosed in any or all of the pultruded housing walls or pulled into the non-metallic armor article 94 remote of the pultruded housing in the same or similar fashion as the plurality of substantially dry broad goods sheets 10 are disposed.

Figure 10:
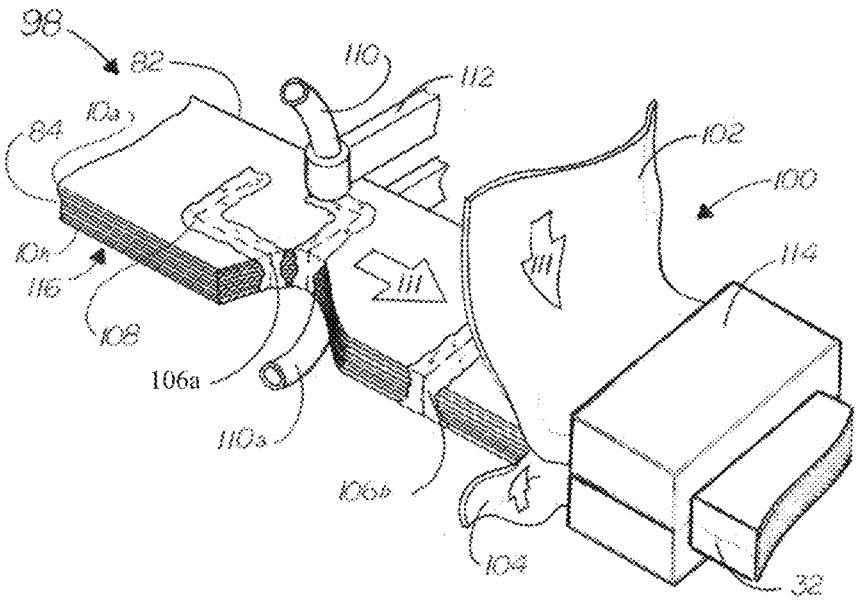
FIG. 10 is a perspective view of an exemplary process for fabricating non-metallic armor articles.

Turning now to FIG. 10, a second exemplary process of forming a non-metallic armor article assembly 98 is described. The various particular implementations of non-metallic armor articles described herein include a pultruded housing 32, which may comprise a pultruded skin (housing substrate). Significantly, a pultruded housing skin 100 (comprising one or more sheets, as described below) and a plurality of substantially dry broad goods sheets 10 are joined or engaged during a fabrication process embodied by the assembly 98. The housing skin 100 (also known as a housing substrate) may comprise a fabric that is at least partially resinated or suffused, or pre-coated or pre-suffused (in some particular implementations, pre-impregnated or "pre-preg" by industry terminology), with a thermosetting polymeric resin (and/or other setting compounds, solutions, and the like), with the housing skin 100 being heated and/or cured during the fabrication process embodied by the assembly 98. The resulting pultruded housing 32, after the fabrication process embodied by the assembly 98, is then a hardened (or semi-hardened) composite skin which at least partially encloses (and engages, as described above) one or more of the plurality of substantially dry broad goods sheets 10 (i.e., one or more layers of ballistic fabric, 3D ballistic panel(s), in any number or any combination thereof) in suspension.

The pultruded housing 32 is at least partially joined with and may engage the plurality of substantially dry broad goods sheets 10 in a state of tension, in a neutral state, or in slack or in any series or combination of such states depending on the desirable operational characteristics of the particular implementation of non-metallic armor article being used. A pultruded housing skin 100 may comprise two or more separate skin sheets 102 and 104 before the pultrusion process, as shown in FIG. 10, or may alternatively comprise one or more wrap-around sheets or numerous layers of sheets or wrappings (not shown). In other words, in some particular implementations, a pultruded housing 32 may completely envelop a plurality of substantially dry broad goods sheets 10, such that the housing forms a continuous cover or encapsulation for the plurality of substantially dry broad goods sheets 10.

In any event, housing skin sheets 102 and 104 may comprise a variety of different fabrics, fibers, resins, shapes, configurations, constructions, and so forth, consistent with this disclosure. A fabrication process embodied by the assembly 98 may be configured to allow a resin (or other compound, solution, and/or the like) to at least partially suffuse the pultruded housing skin and/or one or more layers of the substantially dry ballistic fabric 10 during pultrusion.

Still referring to FIG. 10, other alternative materials could be used for a housing skin 100. By way of non-limiting example, a polymeric skin could be used, such as two solid polymeric sheets, either rigid, semi-rigid, or flexible, and could be added to the pultrusion process (or even melted to be joined with one or more of the plurality of substantially dry broad goods sheets 10, or could be at least partially melted around the plurality of substantially dry broad goods sheets 10, such that the polymer upon re-solidifying would form a permanent bond with the plurality of substantially dry broad goods sheets 10, and thus form a non-metallic armor article (including a pultruded housing 32). In some particular implementations, the pultruded housing 32 could alternatively be any other material or combination of materials that functions to engage the plurality of substantially dry broad goods sheets 10 in at least a partially enclosed state.

In some particular implementations, a pultruded housing 32 may alternatively comprise a non-pultruded skin. For instance, some process other than fabrication process embodied by the assembly 98 may be used to at least partially join or engage a skin with the plurality of substantially dry broad goods sheets 10. As an example, various other processes that can be used to produce the non-metallic armor article include, but are not limited to: resin infusion; pressure molding; compression and/or press forming; vacuum forming; injection molding; and/or numerous variations and/or adaptations of processes utilizing substantially the same principles. An example of a pultrusion process relevant to the present process is shown and described in U.S. Pat. No. 7,331,270, issued Feb. 19, 868, the disclosure of which is hereby incorporated herein by reference.

In those particular implementations of non-metallic armor articles (and/or processes of forming such particular implementations of non-metallic armor articles) where a resin is used to form a composite, any resin system known in the art could be used. By way of non-limiting example, the resin could comprise any acrylic resin, any alkyd resin, any amino resin, any bismaleimide resin, any epoxy resin, any furane resin, any phenolic resin, any polyimide resin, any unsaturated polyester resin, any polyurethane resin, any vinylester resin, any cyanate ester resin, any silicone resin, any arylzene resin, any hybrid resin, any protein resin and/or any other natural and/or synthetic resin system.

Like the example shown and described with reference to FIG. 5, the broad good sheets 10 may be placed into alignment with the other sheets and a pultrusion forming die. Different from the example shown and described with reference to FIG. 5, however, the process implementation described with reference to FIG. 10 includes an additional resin injecting process through the spaced broad goods sheets prior to the skin 100 being added and the assembly being passed through the fabrication machinery 114.

Referring still to FIG. 10, the pultruded housing 32 is joined with a plurality of substantially dry broad goods sheets 10 via a process embodied by the assembly 98 illustrated in FIG. 10. In particular, skin sheets 102 and 104 are arranged so that they at least partially enclose the plurality of substantially dry broad goods sheets 10 (array 116) as the pultruded housing-enveloped array 116 passes through fabrication machinery 114. Fabrication machinery represents fabrication machinery that may be used during the fabrication process embodied by the assembly 98 such as, by way of non-limiting example, a preform and die mouth and/or a resin injection block and/or a final forming and curing die. In any event, before the housing 32 and the array 116 pass through fabrication machinery 114, injection element 110 may pump, inject, force, or otherwise suffuse resin into or onto the top of the plurality of substantially dry broad goods sheets 10 of array 116 which, in the particular implementation shown in FIG. 10, is essentially a tube or spray nozzle through which a resin is pumped. Therefore, injection element 110 is used to join or engage one or more of the plurality of substantially dry broad goods sheets 10 together. As the plurality of substantially dry broad goods sheets 10 and housing skin pass through fabrication machinery 114 in the direction of arrow 111, one or more injection elements can be used to inject a one or more "beads" of resin. A resin bead may be continuous or may be intermittent, such that a resulting resin weld may comprise a substantially continuous resin border, may comprise an intermittent resin border, or may comprise support columns at selected locations across the array 116. The resin bead may serve not only to weld the pultruded housing to one or more layers of the plurality of substantially dry broad goods sheets 10, but also to provide resin saturated areas 106*a*, 106*b*. The later discussions relating to FIGS. 12-16 further illustrate other methods and examples of applying resin beads using various other configurations.

As illustrated in FIG. 10, one or more portions of the plurality of substantially dry broad goods sheets 10 may comprise one or more resin saturated areas 106*a*, 106*b*. A resin saturated area 106*a*, 106*b* comprises a resin "bead" and may be formed into virtually any continuous or intermittent shape. Resin saturated area 106*a* illustrates a resin saturated area that is essentially a square shape in the center of the width of the plurality of substantially dry broad goods sheets 10. A plurality of substantially dry broad goods sheets 10 are shown arranged in a substantially dry broad goods sheets array 116, which may comprise one or more spacings 84 between individual substantially dry broad goods sheets 10 (or the plurality of substantially dry broad goods sheets 10 may be in contact with another layer, with no spacing 84 interposing between the layers). Resin saturated area 106*b* illustrates a resin saturated area that spans the width of the plurality of substantially dry broad goods sheets 10. A resin saturated area can span the entire thickness of the ballistic fabric from an eventual top housing layer to a bottom housing layer, as shown in the cutaway representation of resin saturated area 106*a*, where the resin is injected through the thickness of one or more of the plurality of substantially dry broad goods sheets 10 of broad goods sheets array 116. Alternatively, a resin could be injected into only a portion of the thickness of one or more of the plurality of substantially dry broad goods sheets 10 forming broad goods sheets array 116, such as only on the top layer, or only a few layers deep from the top or bottom, or a few layers deep from the top and a few layers deep from the bottom, and so forth in various other combinations. For the specific example of resin saturated area 106*a*, the resin saturated portion becomes a side-wall 106*a* of the portion of the broad goods sheets array 116 surrounded by the wall. The side-wall 106*a* holds the broad goods sheets in their desired state of tension or slack and maintains their relative spacing.

As depicted in FIG. 10, there could be an additional injection element 110*a* such that a resin could be pumped, injected, forced, or otherwise suffused into or onto the bottom of the non-metallic armor article (and/or one or more of the plurality of substantially dry broad goods sheets 10 of array 116, and/or a skin 100 and/or a pultruded housing 32) or a series of such devices may individually wet one or more layers before such layers are brought together. Another element or elements, not shown in FIG. 10, could be used to inject, pump, or otherwise force or suffuse resin into or onto the non-metallic armor article from a side or sides of the non-metallic armor article in similar manner. One or more injection elements 110, 110*a*, and any other elements used to pump, inject or otherwise force or suffuse resin into or onto the non-metallic armor article (and/or one or more of the plurality of substantially dry broad goods sheets 10 of array 116, and/or a skin 100 and/or a pultruded housing 32) may be guided in one, two, or three dimensional movements by a guiding member 112, as shown in FIG. 10. Fabrication machinery 114 represents fabrication machinery that may be used during the fabrication process embodied by the assembly 98 such as, by way of non-limiting example, a die mouth and/or a resin injection block and/or a final forming and curing die.

Significantly, in some particular implementations of non-metallic armor article, a reinforced resin area 106*a*, 106*b* and one or more cavity divisions (such as horizontal cavity division 88 and vertical cavity division 92) may be one in the same. For instance, as illustrated in FIG. 10, reinforced area 106*a*, 106*b* illustrates at least a vertical cavity division 92. A reinforced resin area 106*a*, 106*b* may comprise a continuous or discontinuous "bead" or stream of resin to reinforce the overall structure of a non-metallic armor article. The resin saturated area 106*b* in FIG. 10 may be placed at a cutoff point where the non-metallic armor article may later be cut such as with a saw or a water jet (such as along the dotted line 108 provided as a non-limiting example only). The resin saturated area 106*a* may also be cut, such as along the dotted line 108 provided as an example, to remove a window area in the laminate (such as with a saw or water jet). The foregoing may be particularly useful where there are windows or other items that need to be operable through a non-metallic armor article and where it would be useful to cut a place for the window or other opening through the non-metallic armor article. A resin saturated area 106 surrounding the border of the cut portions in either case however may serve to protect the inner structure such as the ballistic fabric layers from environmental conditions.

Still referring to FIG. 10, the production of a non-metallic armor article (such as, by way of non-limiting example non-metallic armor article 62, 86, 90, or 94, shown in FIGS. 6-9, respectively, or any other non-metallic armor article contemplated or made possible by these disclosures) in a sheet of any practical length, as well as in predetermined and varying shapes, on a continuous and automated basis, via fabrication process embodied by the assembly 98 is possible. A fabrication process such as that illustrated in FIG. 10 could be used, for instance, to make door panels for specific armored vehicle applications with window cutouts. Those products may be cut from a bulk pultruded armor (such as, by way of non-limiting example, a non-metallic armor article and/or a broad goods sheets array 116) by waterjet, laser, cutting blade or other suitable cutting methods once the material has been pulled through a manufacturing die (which may constitute a curing portion of the process).

In some particular implementations of a fabrication process, a waterjet or other cutting mechanism may cut along one or more resin saturated areas 106 to yield a final product (e.g. a non-metallic armor article). By cutting along the centerline path of one or more resin saturated areas 106*a*, 106*b* (as shown by the dotted lines 72) on resin saturated areas 106*a*, 106*b*, one or more of the plurality of substantially dry broad goods sheets 10 remain anchored to the remaining portion of the resin saturated area 106*a*, 106*b* to produce items of predetermined geometry (such as a square shape), while assuring that all of the substantially dry broad goods sheets 10 comprising array 116 remain captured in their specific position and/or array. All of the substantially dry broad goods sheets 10 comprising array 116 may also be sealed "weather tight" within a pultruded housing 32 produced by the skin 100.

As noted above, substantially dry broad goods sheets array 116 depicts a plurality of substantially dry broad goods sheets 10 (layers 10*a*-10*g*, in this particular implementation). In the assembly 98, the broad goods sheets 10 (and/or array 116) are pulled in the direction indicated by the arrow 111 during the fabrication process. As the one or more of the plurality of substantially dry broad goods sheets 10 (and/or array 116) are pulled in this direction, the plurality of substantially dry broad goods sheets 10 are introduced into one or more cavities 72 located within the pultruded housing 32 (which may be formed by outer skin 100 and 102). As the fabrication process continues, the plurality of substantially dry broad goods sheets 10 are at least partially enclosed by the pultruded housing 32. Resin saturated areas 106*a* and 106*b* may be formed, as described above, by injection elements 110. As the process continues, the individually saturated outer skin sheets 102 and 104 are pulled into the die mouth 114 and/or resin injection block (and around the plurality of substantially dry broad goods sheets 10 forming array 116), as the entire mass is pulled through a final forming and curing die. Fabrication machinery 114 is also a possible location for one or more resin injection mechanisms for wetting the outer skin sheets 102 and 104 (and/or a single skin in those particular implementations employing only a single skin).

Once an entire mass exits the fabrication machinery 114, the pultruded housing 32 is engaged with plurality of substantially dry broad goods sheets 10 such that the pultruded housing 32 is at least partially secured to one or more of the plurality of substantially dry broad goods sheets 10. In addition to the foregoing, once an entire mass exits the fabrication machinery 114, the mass is a fully cured non-metallic armor article portion and can be machined on-the-fly, including by engaging waterjets and/or other equipment. Alternatively in some particular implementations of a fabrication process, one or more finished non-metallic armor article portions can be cut to predetermined lengths then sent to secondary process stations where specialized shapes (including one or more "windows" or other through apertures can be cut).

In some particular implementations of a fabrication process, an ink or pigment (not shown) can used to mark one or more outer skins 100 and 102 (and/or a formed pultruded housing 32) so that the full-cross-section resin paths (in other words, the resin saturated areas 106*a* and 106*b*) are visually apparent. In other particular implementations, various materials can be mixed into a resin and/or applied to a surface (of one or more of the plurality of substantially dry ballistic impact resistant broad goods sheets 10 and/or a array 116, and/or an outer skin 100, and/or an outer skin 102, and/or a formed pultruded housing 32) concurrent to the formation of the full-cross-section resin path (of one or more resin saturated areas 106) so that automated equipment with sensing capability can easily detect the location of the full-cross-section resin paths (of one or more resin saturated areas 106). Ink or pigment, or metallic tracing could also be used to indicate a cut line (such as dotted line 108) along one or more resin saturated areas 106. This arrangement may be particularly useful, for instance, if the cutting is to be done in a separate process or at another facility.

While the foregoing fabrication process embodied by the assembly 98 may be used to manufacture a non-metallic armor article, many other processes could alternatively be used. Some of these have already been explained. It will be appreciated by those skilled in the art that other processes such as, but not limited to, resin infusion, pressure molding, compression and press forming, and numerous variations and adaptations of processes utilizing substantially the same principles, may be used to manufacture a non-metallic armor article consistent with these disclosures. After manufacture (such as via fabrication process embodied by the assembly 98), one or more non-metallic armor article portions may be used in conjunction with various "pin-carriage" vehicle frame adaptations (mounting posts) so that one or more layers of armor articles may be stacked (together or spaced) to allow variable protection to a vehicle or structure.

Figure 11:
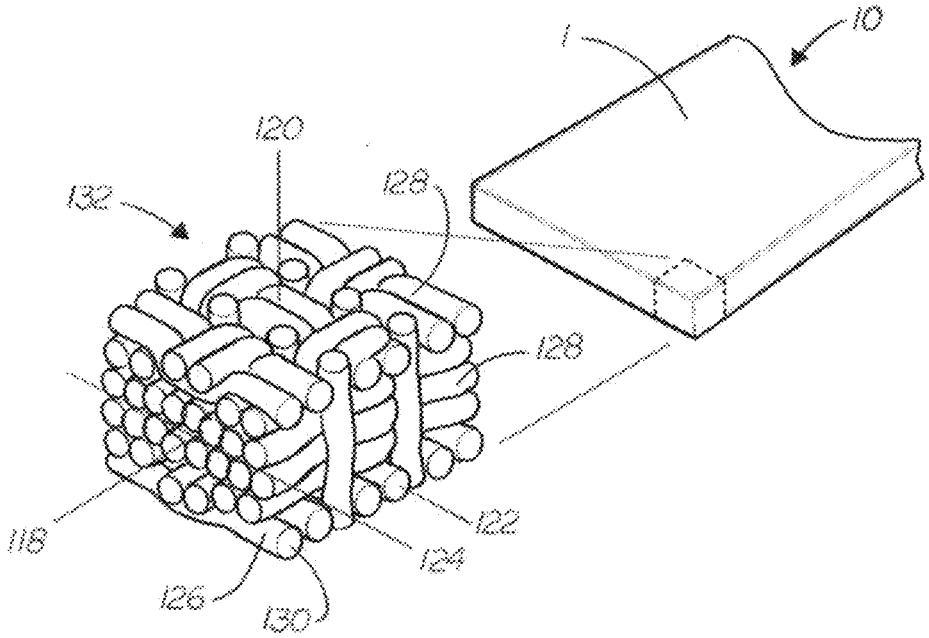
FIG. 11 is a perspective view of a substantially dry ballistic layer, including detailed view A.

Turning now to FIG. 11, this figure representatively depicts a typified substantially dry ballistic layer 10. The exploded portion representatively depicts, without limitation as to specific arrangements, proportions, or combination of materials, a typified portion of the substantially dry ballistic layer 10. The fibers and materials to each of the axes 118, 120, 122 may vary in number, type, combination, grouping arrangement, material makeup, and all other properties and may include any combination, kind, or sized off-axis fibers or materials including for the purpose of stitching, weaving or otherwise substantially fixing the structure of the resulting panel which may itself be a lamination of multiple such panels as generally depicted by center line 124 which representatively depicts the geometric center line of the illustrated panel portion whereby mirror image panels, or panels of unlike geometry might be attached or joined to form a thicker single ballistic panel as an alternative to multiple panels.

Some of the processing variations described above are generally used to produce products of substantially uniform cross sectional properties, meaning all or most of the reinforcing fibers 126 are retained within a matrix 132 having generally homogenous cross-sectional properties. In some particular implementations, however, a non-metallic armor article may comprise a matrix 132 wherein the reinforcing fibers, configured as one or more broad goods sheets, remain substantially dry or un-bound, or generally non-homogeneous in the cross section so that the reinforcing fibers 126 can act effectively in defeating ballistic, fragment, and blast shock threats.

By non-limiting example, FIGS. 6-9 illustrate several particular implementations where there are a plurality of substantially dry broad goods sheets 10 that are suspended in one or more cavities 72. Thus, most of the reinforcing fibers 126 (FIG. 11) of the substantially dry ballistic layer 10 are not bound within the matrix 132. In some particular implementations, one or more reinforcing fibers 126 may be partially wet during processing, such that they are substantially dry or substantially un-bound from the matrix 132 upon completion of processing, but not completely dry or completely unbound from the matrix 132. Another way to describe the dryness of the fibers is to say that they are at least substantially resin starved, meaning lacking resin within the core cross section 130 of the armor article, although some fibers 126 may be suffused with resin on the outer surfaces 128 of the fibers, such as where one or more fibers 126 are near or are touching the pultruded housing 32 (not shown in FIG. 11). The one or more reinforcing fibers 126 may thus be fully resin starved or only substantially resin starved. The substantially dry state of the fibers may be achieved by ensuring that resin does not reach some of the fibers 126, or that only a limited amount of resin reaches one or more fibers (on the inner portions of the non-metallic armor article) during processing.

The term "substantially dry" is also specifically intended to encompass various situations where one or more reinforcing fibers 126 comprising the one or more of the plurality of substantially dry ballistic impact resistant broad goods sheets 10 are individually or as a group suffused, treated and/or coated with at least semi-wet chemicals, including lubricants, before the non-metallic armor article is processed (such as via fabrication process embodied by the assembly 98), and then after processing of the non-metallic armor article some residuals of the chemicals and/or lubricants remain. The term "substantially dry" is also intended to encompass various situations where one or more reinforcing fibers 126 are coated in a "pre-preg" resin which is substantially pre-cured (and/or pre-dried) before processing of the non-metallic armor article, but where the pre-preg resin does not "lock" or bind a majority of the individual fibers during processing of the non-metallic armor article due at least to one or more particular processing parameters being optimized to ensure that the pre-preg resin does not bind a majority of the individual fibers during processing.

By way of non-limiting example, some reinforcing fibers 126 may be coated with pre-preg resin after individual fibers 126 are twisted into a roving or bundle (not shown) of individual fibers, or during the process of producing woven materials. To ensure "substantially dry" fibers, one or more reinforcing fibers 126 could be chosen that do not have significant amounts of pre-preg resin, or the temperature and/or pressure during processing could be configures to ensure that substantial bonding of fibers to one another via the pre-preg resin does not substantially occur. Some insubstantial amount of bonding between fibers would be acceptable and the fibers 126 in such a scenario would still be considered "substantially dry" as that term is meant to be used in this application.

The novel purpose of maintaining one or more reinforcing fibers 126 in a substantially dry state within an outer skin (and/or a pultruded housing 32) is to allow the reinforcing fibers 126 to substantially remain unbound and unrestricted in their movement as they react to ballistic impacts from bullets, ordnance, fragments, and so forth. As such, even if one or more pre-preg fibers were used, and even if a substantial amount of the reinforcing fibers 126 were bonded to one another during processing, but the bonds were substantially weak such that in an impact the fibers would easily break away from one another and would be almost instantly free to move with respect to one another, this would also be a situation where the reinforcing fibers 126 would be considered substantially dry. In summary, the touchstone of "substantially dry" or is how easily the fibers may move with respect to one another during an impact. If they are substantially unrestricted in their movement with respect to one another during an impact, even if they are weakly bonded before the impact, they are "substantially dry" as that term is meant to be understood in this application.

In addition to the foregoing, it will be understood that a non-metallic armor article may be manufactured such that one or more reinforcing fibers 126 of one or more of the plurality of substantially dry ballistic impact resistant broad goods sheets 10 remain substantially dry regardless of which manufacturing process is used. In other words, the "substantially dry" state of the one or more fibers 126 is not limited only to particular implementations of non-metallic armor articles manufactured using pultrusion. Rather, particular implementations of non-metallic armor articles using any manufacturing technique or fabrication process can be manufactured such that the reinforcing fibers 126 of one or more of the plurality of substantially dry ballistic impact resistant broad goods sheets 10 are substantially dry. For instance, manufacturing techniques such as resin infusion, pressure molding, compression and press forming, vacuum forming, injection molding, and numerous variations and adaptations of similar processes enumerated above may be configured so as to ensure that the reinforcing fibers 126 within the non-metallic armor article are substantially dry. In some cases, including without limitation the above referenced alternatives to pultrusion processing, the dry ballistic impact resistant broad goods may be die cut to representative forms of the armor article to be produced so that when the outer skin is formed a near final armor article is produced. The dry ballistic impact resistant broad goods would remain spatially secured and substantially unbound within the cross section of the armor article and incased in a hard shell.

Figure 12:
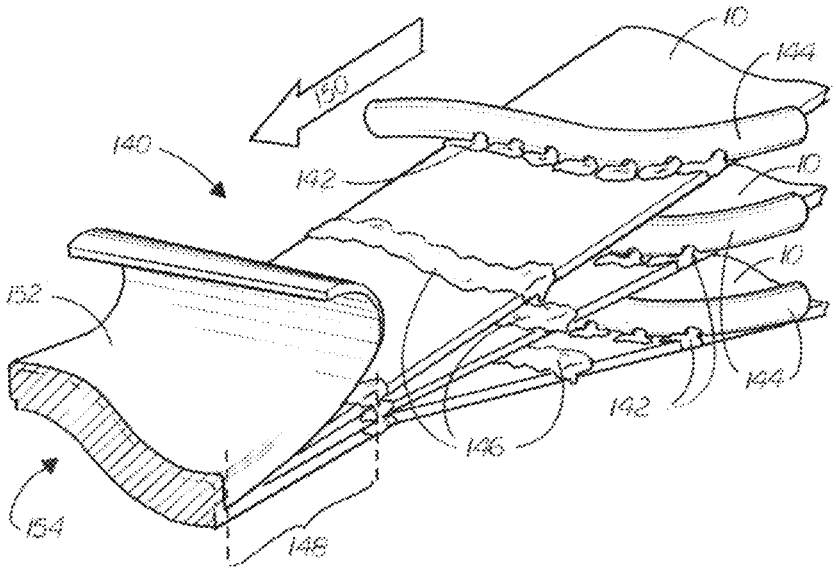
FIG. 12 is a perspective view of another exemplary process for fabricating non-metallic armor articles.

FIG. 12 illustrates another method 140 of fabricating an armor article using substantially dry ballistic impact resistant broad goods sheets 10. The collective ballistic sheets 10 may be patterned with wet resin 142 from suitable resin dispensers 144. Suitable resin dispensers include, but are not limited to, such dispensers as tubes, nozzles, valves and the like. The pattern for any of the implementations disclosed herein may take on any desired geometry, including without limitation variable end-cut tapers and/or closed or open-end loops of any configuration. Sequentially, as the resin soaks or is wicked into and about the approximate area of the original resin wetting, a full cross section wet-out portion 146 is affected as the ballistic fabrics and other components are drawn or otherwise positioned together by any suitable process to constitute a consolidated, resin saturated, cross section. The wet-out portion in this and other Figures also serves as a side-wall for a housing cavity as described elsewhere in this disclosure. The process traps the ballistic sheets as a ballistic laminate and allows specific shapes to be cut from the bulk laminate along the consolidated cross section 148 after the resin has been cured.

For example and without limitation, FIG. 12 illustrates these principles adapted to the pultrusion process, progressing in the direction indicated by arrow 150, schematically depicting the sequential introduction of the housing 152, formed around the consolidated ballistic fabrics and full cross section wet-out path. These manufacturing principles, adapted to various manufacturing processes, allow a ballistic laminate to be cut along any such pattern to produce ballistic articles of virtually any desired shape. While the schematic representation of FIG. 12 illustrates a flat panel ballistic laminate 154, without limitation, the ballistic laminate may be pultruded or formed by other suitable forming processes to take on any desired geometric configuration including curved and annular laminated panels and/or sections. Resin patterning may be accomplished by any suitable process and mechanism, including without limitation metered and/or valve-like dispensing tubes or other conveyance and/or dispensing portions controlled by any suitable controller, including without limitation, electronic, mechanical and/or electro-mechanical controllers.

Figure 13:
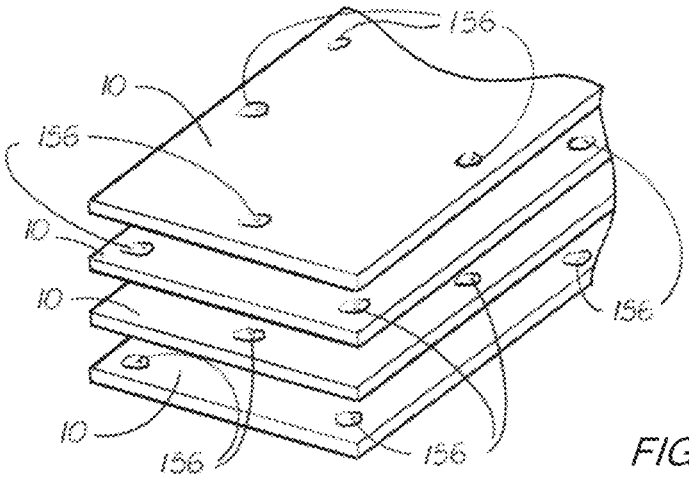
FIG. 13 is a perspective view of an arrangement of resin placement between layers of substantially dry ballistic broad goods sheets.

FIG. 13 illustrates an arrangement of resin placement between layers of substantially dry ballistic broad goods sheets. In this example, the relative positions of the various ballistic sheets 10 and/or other internal components to the ballistic laminate of may be fixed by resin pinning, whereby two or more layers 10 of ballistic components and/or other components may be secured by a relatively small amount of resin formed in a resin pad 156, or other suitable bonding material or materials (collectively "resin pad"). By resin pinning, the movement of those layers 10 may be secured, including resisting their displacement when exposed to dynamic shock and/or other movements or causes, or so that the layers 10 may work together to increase the stiffness or rigidity of the consolidated ballistic laminate assembly. The small amounts of resin 10 or other suitable bonding materials may be positioned randomly or in programmed sequence so as to limit and/or predict their alignment and increase the effectiveness of the resin pinning or to minimize the potential for degrading the ballistic capability of the laminate.

While FIG. 13 schematically illustrates this resin pinning as drop-like accumulations of resin pads 156, alternatively and without limitation, the resin or other suitable bonding material or materials may take on any other suitable geometric pattern or patterns, and may from vary one layer 10 to the next. Resin pinning may be accomplished by any suitable resin dispenser, process or mechanism including, without limitation, including such resin dispensers such as nozzles, valves, tubes and the like in any pattern or quantity. Resin dispensers may be controlled by any suitable process and mechanism, including without limitation metered and/or valve-like dispensing tubes or other conveyance and/or dispensing portions controlled by any suitable controller, including without limitation, electronic, mechanical and/or electro-mechanical controllers. Alternatively, the ballistic fabric layers 10 and/or other materials and components to the ballistic laminate may be mechanically pinned by any suitable process or mechanism or combination of mechanisms including, without limitation, stitching, needling, stapling and/or nailing. Those of ordinary skill in the art will understand how each of these pinning processes would be accomplished in combination with the described system and processes from the disclosure included herein.

Figure 14:
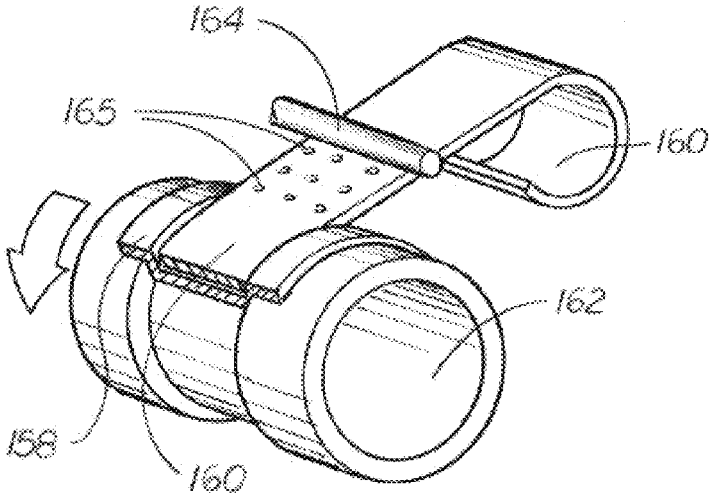
FIGS. 14, 14*a*, 14*b* and 14*c* are perspective views of a non-metallic armor article fabrication process for producing products in curved form.

FIG. 14 illustrates a method of forming ballistic laminates and products so they are configured substantially annular or curved in form, whereby the inner portion of the housing or tray 158, may consist of preformed sheet-like component or components of any suitable material. Suitable sheet-like components include, without limitation, certain alloys, ceramic, polymers, hybrid and reinforced materials, for example and without limitation, as may be desirable to providing a ducting surface or liner to a jet engine approximate the engine's compressor blades providing integral structural properties and protection from engine component fragmentation. Likewise, the outer portion 168 of the housing, may also consist of preformed sheet-like component or components of any suitable material. Additionally, portions of the ballistic laminate sheets and other assemblies 160 disclosed throughout this disclosure may be integrated in section, or more fully in annular forms and seated between the inner portion 158 of the housing and the outer portion 168 of the housing. By non-limiting example, it is contemplated that such curved assemblies may be used as housing for fuselage constructions to provide comprehensive and/or localized ballistic and fragmentation protection to an aircraft's pressure vessel, flight operations systems, and occupants.

Figure 14A:
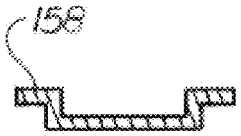
Figure 14B:
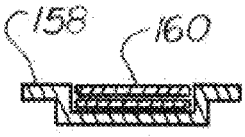
Figure 14C:
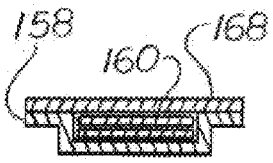

As schematically illustrated in FIG. 14 above, the ballistic laminate assembly 160 may be conveyed by suitable mechanism 164 to pass approximate optional resin or other pinning 165 prior to engaging a forming mandrel 162 which may be stationary or rotating and which accommodates the housing inner portion 158, in preform, cured, or wet state, as illustrated in representative cross section FIG. 14A. Ballistic laminates 160 may be selectively wound or otherwise positioned approximate the housing inner portion 158, as indicated generally by cross section FIG. 14B, before the housing outer portion 168 is joined to the inner portion 158 by appropriate process as generally illustrated by cross section FIG. 14C.

In the case of wet forming the inner portion 158 and/or outer portion 160 by the process schematically illustrated in FIG. 14, the housing portions 158 and 160 may be positioned approximate the mandrel 162 in resin saturated states. If positioned in a resin saturated state, such portions 158 and 160 may require final curing processes such as exposure to appropriate temperature and/or pressure conditions as possible by utilizing an autoclave or other suitable mechanism for compressing or securing the assembly during curing.

For example, the inner portion or portions 158 may be resin saturated by any suitable process or mechanism, including but not limited to wet-out submersion or resin injection, then positioned approximate the mandrel 162, including without limitation by winding or otherwise selectively positioning before the ballistic laminates 160 are circumferentially positioned approximate the inner portion 158. Thereafter, the outer portion 168 of the housing may be formed in similar fashion and variation to the inner portion 158. More specifically and without limitation, housing materials may include, glass, carbon, hybrid or synthetic fibers in roving, woven, stitched, or other suitable configuration matched to an appropriate resin or binding system. The process may include or incorporate filament, mandrel winding and/or other suitable processes including compression molding, pressure forming, vacuum forming and the like.

In the case of dry forming the inner portion 158, preformed or flexible sheets including without limitation those consisting of certain alloys, formable polymers such as SMC, ceramic, glass, carbon, hybrid or synthetic fibers in roving, woven, stitched, prepreg or other suitable constitution, may be positioned approximate the mandrel 162 before ballistic laminates are brought into position, as detailed above relative wet forming. This would also occur before employing suitable consolidation processes such as final curing of prepreg and/or other portions under specific heat and pressure conditions, for example and without limitation, as possible by utilizing an autoclave or other suitable heat and/or pressure mechanisms.

Figure 15:
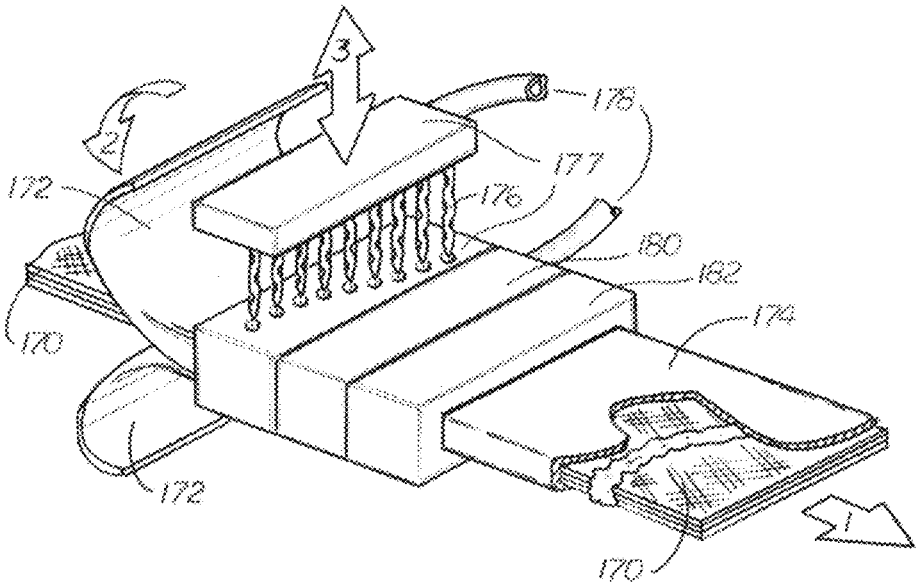
FIG. 15 is a perspective view of a particular implementation of a non-metallic armor article fabrication process and fabrication machine.

FIG. 15 illustrates another particular implementation of a non-metallic armor article fabrication process and fabrication machine whereby ballistic fabric elements and other internal components, collectively ballistic layers 170, may be fed into a fabrication machine as indicated by arrow 2, thereby being formed along with housing portion components 172. Housing portion components 172 may comprise alloys, formable polymers such as SMC, ceramic, glass, carbon, hybrid or synthetic fibers in roving, woven, stitched, prepreg or other suitable constitution. Housing portion components eventually form finished housing portion 174 in the direction of arrow 1.

As illustrated in FIG. 15, the ballistic layers 170 and housing portion components 172 are drawn or progress in process in dry or substantially dry state so as to come into position approximate resin injection needles 176, fed by a resin supply 178 and supported by resin injection needle guides 177 which are configured to move up and down in the direction of arrows 3. As the dry or substantially dry ballistic layers 170 pass by the resin injection needles 176, portions of the ballistic layers 170 may be injected along selectable pathways and more complex geometric shapes or patterns to provide a suitable condition to the cross section of the lamination for cutting or segregating the ballistic laminate panels (articles) described elsewhere in this disclosure proximate those pathways and/or patterns.

By the process schematically illustrated in FIG. 15, dry or substantially dry ballistic layers 170 can be patterned as described above, then drawn or otherwise progressed in process to suitable housing portion wet-out mechanisms, including without limitation, a resin injection or infusement mechanism 180, before being drawn or otherwise progressed in process to a suitable curing mechanism 182 as may be desirable to form the housing portion. In some cases, it may be desirable to provide more than one curing mechanism 182. For example and without limitation, heavily saturated pathways and/or patterns may require increased or additional forms of energy in order to fully cure at a rate comparable to the housing portions which may be cured at very high production speeds by such simple and effective means as electrically or otherwise heated forming dies.

While this FIG. 15 schematically illustrates these manufacturing steps adapted to the continuous pultrusion process, it is understood that these principles may also be accommodated by other forms, or combinations of manufacturing processes, including without limitation, filament winding, mandrel winding and other suitable processes including compression molding, pressure forming, vacuum forming and the like.

Figure 16:
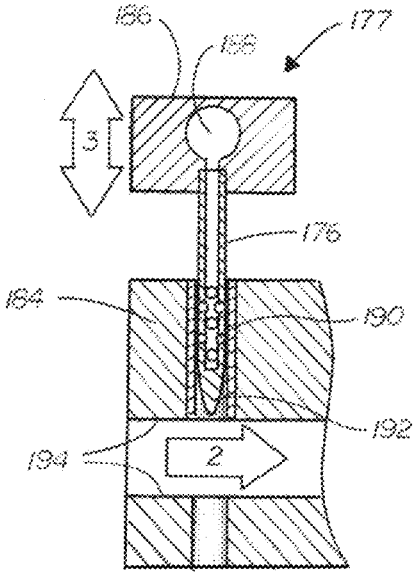
FIG. 16 is a cross-sectional view of a portion of the fabrication machine of FIG. 15.

FIG. 16 is a cross-sectional view of a portion of the resin needle guide 177 of FIG. 15. Ballistic layers 170 which are to be infused with pathways or patterns of resin, for the segregation of ballistic laminates and articles may pass through a preform-like section 184, generally in the direction of arrow 2, moving approximate resin injection needle supports 186. The resin injection needles 176 serve to saturate the ballistic laminate's cross section as described more fully with reference to previous Figures. Such saturation includes saturation along selectable pathways and more complex geometric shapes or patterns to provide a suitable condition to the cross section of the lamination for cutting or segregating the ballistic laminate panels, articles and products proximate those pathways and patterns. The saturation occurs as the flow of resin supplied by inlet 188, to the needles 176 in a controlled manner. Such control may include, without limitation, pressurized resin being released as the needle support 186 is actuated in selectable cycle in the directions generally indicated by arrow 3.

For example, the needles' 176 movement downward and out of position respective the body of the preform-like section 184 releases the resin through needle ports 190, into the cross section of the laminate along the desired pathway, thereafter cycling to the normal or closed position, ending the resin flow until the next indicated cycle. The tip of the resin injection needles 192 may have a progressive geometry other than as illustrated by FIG. 16, so as to least affect the displacement of the ballistic layers 170 (FIG. 15) as they are pierced in the tight confines of the preform-like section's 184 facing surfaces 194.

It will be recognized by those of ordinary skill in the art that all of the armor products disclosed herein may be used not only as protective armor for vehicles, but also for many other protective purposes. The products may be formed in such sizes and shapes as to be usable as personal armor, siding and roofing for structures, structural panels for construction of ballistic resistant structures, and panels and sheets of the products may in an emergency simply be propped up for persons under attack to shelter behind. Those skilled in the art will recognize numerous other uses and applications for which the products of the various particular implementations of non-metallic armor articles disclosed herein may be employed.

The various implementations listed here, and many others, will become readily apparent from this disclosure. From this, those of ordinary skill in the art will readily understand the versatility with which this disclosure may be applied.

Implementations of a non-metallic armor article may be constructed of a wide variety of materials as has been described above. Those of ordinary skill in the art will readily be able to select appropriate materials and manufacture these products from the disclosures provided herein.

Some components defining a non-metallic armor article may be manufactured simultaneously and integrally joined with one another, while other components may be purchased pre-manufactured or manufactured separately and then assembled with the integral components. Various implementations may be manufactured using conventional procedures as added to and improved upon through the principles described here.

Accordingly, manufacture of these components separately or simultaneously may involve pultrusion, vacuum forming, injection molding, blow molding, milling, drilling, reaming, stamping, pressing, cutting and/or the like. Components manufactured separately may then be coupled or removably coupled with the other integral components in any manner, such as with adhesive, a weld joint, a fastener any combination thereof, and/or the like for example, depending on, among other considerations, the particular material forming the components.

It will be understood that implementations are not limited to the specific components disclosed herein, as virtually any components consistent with the intended operation of a method and/or system implementation for a non-metallic armor article may be utilized. Accordingly, for example, although particular component examples may be disclosed, such components may comprise any shape, size, style, type, model, version, class, grade, measurement, concentration, material, weight, quantity, and/or the like consistent with the intended operation of a method and/or system implementation for a non-metallic armor article may be used.

In places where the description above refers to particular implementations of a non-metallic armor article, it should be readily apparent that a number of modifications may be made without departing from the spirit thereof and that these implementations may be applied to other non-metallic armor articles. The presently disclosed implementations are, therefore, to be considered in all respects as illustrative and not restrictive.

The invention claimed is:

1. A method of manufacturing a ballistic laminate in an at least partially curved formation, comprising:

engaging a ballistic laminate assembly with a tray of an inner portion of a forming mandrel;

winding the ballistic laminate assembly at least partially around the tray of the inner portion of the forming mandrel; and coupling an outer portion to the tray of the inner portion such that the ballistic laminate assembly is positioned between the outer portion and the tray of the inner portion.

2. The method of claim 1, further comprising manufacturing the ballistic laminate assembly by aligning a plurality of ballistic broad goods sheets in a planar array.

3. The method of claim 2, further comprising pultruding a housing around the planar array of ballistic impact resistant broad goods sheets, the housing defining a cavity within the housing, the cavity encompassing at least a portion of the planar array such that the encompassed portions of the ballistic impact sheets within the cavity are substantially dry.

4. The method of claim 2, wherein manufacturing the ballistic laminate assembly comprises aligning the plurality of ballistic broad goods sheets in the planar array in a laminate housing defining at least one cavity.

5. The method of claim 1, further comprising positioning the tray of the inner portion proximate the mandrel in a resin saturated state.

6. The method of claim 5, further comprising preparing the tray of the inner portion in the resin saturated state by one or more of wet-out submersion and resin injection.

7. The method of claim 5, further comprising positioning the outer portion of the tray proximate the tray of the inner portion in a resin saturated state.

8. The method of claim 7, further comprising preparing the outer portion in the resin saturated state by one or more of wet-out submersion and resin injection.

9. The method of claim 7, further comprising curing the tray of the inner portion and the outer portion.

10. The method of claim 1, further comprising dry forming the tray of the inner portion and positioning the tray proximate the mandrel.

11. The method of claim 1, further comprising resin pinning the ballistic laminate assembly prior to engaging the tray of the inner portion.

12. A ballistic layer of a non-metallic armor article, comprising one or more broad goods sheets comprising a plurality of substantially dry reinforcing fibers retained within a matrix in a non-homogenous cross section, wherein the plurality of substantially dry reinforcing fibers are partially wet during processing and substantially dry and substantially unbound from the matrix after processing.

13. The ballistic layer of claim 12, wherein the plurality of substantially dry reinforcing fibers are devoid of resin or comprise resin only on an outer surface of the plurality of substantially dry reinforcing fibers.

14. The ballistic layer of claim 12, wherein the plurality of reinforcing fibers are treated with an at least semi-wet chemical, the at least semi-wet chemical.

15. The ballistic layer of claim 12, wherein the plurality of reinforcing fibers are coated in a pre-preg resin that is substantially pre-cured before processing and wherein the pre-preg resin does not bind to a majority of the plurality of reinforcing fibers during processing.

16. The ballistic layer of claim 15, wherein the plurality of reinforcing fibers are coated with the pre-preg resin after individual fibers of the plurality of reinforcing fibers are twisted into a bund of individual fibers.

17. The ballistic layer of claim 15, wherein one or more of the plurality of reinforcing fibers is substantially devoid of pre-preg resin.

18. A non-metallic armor article, comprising:

a pultruded housing defining at least one cavity; and one or more substantially dry broad goods sheets in a planar array within the cavity, the one or more substantially dry broad goods sheets comprising a plurality of substantially dry reinforcing fibers retained within a matrix in a non-homogenous cross section, wherein the plurality of substantially dry reinforcing fibers are partially wet during processing and substantially dry and substantially unbound from the matrix after processing.

19. The non-metallic armor article of claim 18, wherein the plurality of substantially dry reinforcing fibers are devoid of resin or comprise resin only on an outer surface of the plurality of substantially dry reinforcing fibers.

20. The non-metallic armor article of claim 18, wherein the plurality of reinforcing fibers are treated with an at least semi-wet chemical, the at least semi-wet chemical.

21. The non-metallic armor article of claim 18, wherein the plurality of reinforcing fibers are coated in a pre-preg resin that is substantially pre-cured before processing and wherein the pre-preg resin does not bind to a majority of the plurality of reinforcing fibers during processing.

22. The non-metallic armor article of claim 21, wherein the plurality of reinforcing fibers are coated with the pre-preg resin after individual fibers of the plurality of reinforcing fibers are twisted into a bund of individual fibers.

23. The non-metallic armor article of claim 22, wherein one or more of the plurality of reinforcing fibers is substantially devoid of pre-preg resin.

* * * * *